US006412159B1

(12) United States Patent
Moreau et al.

(10) Patent No.: US 6,412,159 B1
(45) Date of Patent: Jul. 2, 2002

(54) BORDER RETAINER

(76) Inventors: Michael J. Moreau, 1507 Debra St., Bossier City, LA (US) 71111; Mickey T. Coleman, 1152 Waller, Bossier City, LA (US) 71112

( * ) Notice: Subject to any disclaimer, the term of this patent is extended or adjusted under 35 U.S.C. 154(b) by 0 days.

(21) Appl. No.: 09/789,436

(22) Filed: Feb. 20, 2001

(51) Int. Cl.[7] ..... B25B 27/14
(52) U.S. Cl. ..... 29/281.1; 156/574
(58) Field of Search ..... 29/281.1; 30/289, 30/294, 286, 287, 292, 293; 242/599.3, 599.1; 156/574, 579

(56) References Cited

U.S. PATENT DOCUMENTS

| | | | | |
|---|---|---|---|---|
| 3,490,152 A | | 1/1970 | Printz | |
| 3,862,494 A | | 1/1975 | Anderson | |
| 4,072,547 A | | 2/1978 | Pavnica | |
| 4,077,124 A | | 3/1978 | Christmann | |
| 4,490,198 A | | 12/1984 | Mitchell | |
| 5,478,432 A | * | 12/1995 | Vester | 156/574 |
| 5,628,867 A | * | 5/1997 | Renaud | 156/574 |
| 5,775,633 A | * | 7/1998 | Zane | 242/599.1 |

* cited by examiner

*Primary Examiner*—Joseph J. Hail, III
*Assistant Examiner*—Daniel Shanley

(74) *Attorney, Agent, or Firm*—R. Keith Harrison

(57) ABSTRACT

A border retainer for retaining a decorative wall border segment on a wall after the border segment is pasted on the wall, to prevent the applied border segment from inadvertently curling up and detaching from the wall during the border-hanging operation when it is necessary to temporarily release the border segment before the border application paste dries. The border retainer is characterized by a retainer body typically fitted with a handle. A pair of wall inertion spikes extends from fixed or removable attachment to the retainer body for insertion in the wall and removably attaching the retainer body to the wall, and a retainer flange is provided on the retainer body. After the border segment is applied to the wall typically begin at one end and progressing to the opposite, extending end of the border segment, the extending end portion of the border segment initially remains unpasted to the wall and is retained by the retainer flange of the retainer body. The retainer flange prevents the border segment from curling up and detaching from the wall before the border application paste dries as the person hanging the border temporarily releases the border segment in preparation for pasting an overlapping, second border segment of the border on the wall after removing the border retainer from the wall. In another embodiment of the invention, at least one retainer clip instead of or in addition to the retainer flange is provided on the retainer body for holding the free extending end portion of the border segment.

20 Claims, 3 Drawing Sheets

BORDER RETAINER

BACKGROUND OF THE INVENTION

1. Field of the Invention

This invention relates to devices for hanging wallpaper and decorative wall borders. More particularly, the invention relates to a border retainer for retaining a decorative wall border segment on a wall after the border segment is pasted on the wall and before the application paste dries, to prevent the applied border segment from inadvertently curling up and detaching from the wall as the border segment is temporarily released in preparation for pasting an overlapping border segment on the wall. In a preferred embodiment, the border retainer of this invention is characterized by a retainer body having an attachment panel typically fitted with a handle. A pair of wall insertion spikes extends from fixed or removable attachment to the attachment panel for insertion in the wall and removably attaching the retainer body to the wall, and a bottom panel fitted with a retainer flange extends from the attachment panel. As the border segment is applied to the wall typically beginning at one end and progressing to the opposite, extending end of the border segment, the extending end portion of the border segment initially remains unpasted to the wall. The retainer body is attached to the wall, and the free extending end portion of the border segment is rested on the bottom panel and retained by the retainer flange of the retainer body. The retainer flange prevents the border segment from inadvertently curling up and detaching from the wall as the person hanging the border temporarily releases the border segment typically to reposition a ladder, equipment or furniture in preparation for pasting an overlapping, second border segment of the border on the wall. The extending end portion of the border segment is pasted to the wall and the overlapping border segment covers the small openings in the wall caused the wall insertion spikes of the border retainer after the border retainer is removed from the wall. In another embodiment of the invention, at least one retainer clip is provided on the retainer body instead of or in addition to the retainer flange for securing the extending end portion of the border segment. In still another embodiment, the retainer flange is semicircular and extends directly from the attachment panel.

Decorative wall borders are commonly applied to interior walls of homes and businesses typically beneath the ceiling-wall juncture to enhance the aesthetic appearance of the home or business interior. Typically, the packaged border is unwound from a roll or spool and cut into multiple border segments, each of which is applied to the wall typically beginning at one end and progressing to the extending end of the border segment, by initially wetting the attachment surface of the segment to activate the paste on the surface and then pressing the wetted attachment surface against the wall. An adjacent border segment is in like manner applied to the wall in overlapping relationship to the first border segment. Because the applied border segment, previously wound on the spool or roll, has a strong tendency to curl up before the paste dries, the border seat typically becomes detached from the wall under circumstances in which it is necessary for the person hanging the border to temporarily release the border segment typically in order to reposition a ladder, equipment or furniture and facilitate continued application of the border. Accordingly, a device is needed for temporarily retaining the border segment on a wall, to prevent the applied border segment from inadvertently curling up and detaching from the wall as the border hanger deems it necessary to temporarily release the border segment before the border application paste dries during the border-hanging operation.

2. Description of the Prior Art

Various devices for facilitating the application of siding, wallpaper or borders to walls, are known in the art. One of these devices is the "Building Siding Applicator Tool", disclosed in U.S. Pat. No. 3,490,152, dated Jan. 20, 1970, to Printz. The Printz tool is characterized by a handle having a lower portion adapted to be removably clam to the lower edge of a siding strip which has been applied to the exterior surface of a wall. An upper portion of the handle has an upwardly-opening socket for receiving the lower edge of a second siding strip and positioning openings the second siding strip above and in overlapping relationship with respect to the first siding strip as the second siding strip is applied to the wall.

U.S. Pat. No. 3,862,494, dated Jan. 28, 1975, to Andersson, discloses a "Hand Tool for Clean Cutting of Fit-Up Wallpapers, Fitted Carpets and the Like". The Andersson tool is characterized by a wallpaper trimming guide having horizontal and vertical flanges joined at a corner for guiding a trimming knife or the like. The free edge of the horizontal flange has a vertical handle flange disposed at a right angle thereto and provided with a hand-grip slot adjacent to a similar slot in the horizontal flange to define a secure hand grip.

A "Paperhanging Hand Tool and Method" is detailed in U.S. Pat. No. 4,072,547, dated Feb. 7,1978, to Pavnica, according to which method a T-shaped tool including an elongated handle and a perpendicular crosspiece support a draped-over roll of wallpaper which is cut to wall height with its adhesive surfaces facing outwardly. A portion of the wallpaper hangs down from the crosspiece on one side of the tool for application to the lower portion of the wall surface. The remaining portion of the roll hangs down on the opposite side of the tool with its adhesive surface facing the workperson, who carries the tool by grasping the lower end of the handle. The crosspiece is pushed upwardly against the wallpaper to progressively apply the wallpaper to the wall from the floor to the ceiling.

A "Paper Hanging Trimming Tool" is described in U.S. Pat. No. 4,077,124, dated Mar. 7, 1978, to Christmann. The Christmann tool is used in the application of wallpaper to walls and is characterized by a frame shaped like an isosceles triangle, with a rotatable knife blade provided at each of the two base apices of the frame. The tip apex of the frame is rounded to facilitate folding the wallpaper into a corner between joining walls, and the edges adjacent to the tip apex are rounded to serve as guides for the respective knife blades as the blades are used to cut the wallpaper.

U.S. Pat. No. 4,490,198, dated Dec. 25, 1984, to Mitchell, describes a "Method of Hanging Wallpaper", wherein a wallpaper hanging tool includes a guide plate assembly having a pair of paper clamps on one side, and an elongated edge which serves as a guide over which wallpaper is drawn and then clamped. A handle is centrally attached to the guide plate assembly, and wallpaper held by the clamps is positioned at the ceiling edge of a wall and then cut at the ceiling edge and smoothed downward.

U.S. Pat. No. 5,775,633, dated Jul. 7, 1998, to Zane, details a "Wallaper Border Roll Holder" for holding wallpaper border material at a ceiling-wall juncture during application of the border to a wall. The tool includes a handle, a rotatable shaft and a shelf provided on the shaft for supporting a roll of the border material. A fixed bottom spike and a spring-loaded top spike are provided on opposite ends of the shaft for securing the shaft to the wall and ceiling, respectively. The border roll, supported on the shelf, rotates with the shaft and shelf as the border is dispensed from the roll and applied to the wall.

An object of the present invention is to provide a border retainer for preventing inadvertent curling and detachment of a freshly-applied decorative wall border segment from a wall under circumstances in which it is necessary for a person hanging the border to temporarily release the border segment before the border application paste dries during the border-hanging operation.

Another object of the invention is to provide a border retainer for retaining the free extending end portion of a decorative wall border segment after the border segment is applied to a wall and before the border application paste dries, to prevent the applied border segment from inadvertently curling up and detaching from the wall while the person hanging the border temporarily releases the border segment typically in order to reposition a ladder, equipment or furniture preparatory to pasting a second border segment in overlapping relationship to the first border segment on the wall.

Still another object of the invention is to provide a border retainer characterized by a retainer body having multiple wall insertion spikes for removable insertion in a wall and removably securing the retainer body to the wall, and a retaining mechanism provided on the retainer body for engaging the free extending end portion of a decorative wall border segment applied to a wall in order to retain and prevent inadvertent curling and detachment of the border segment from the wall as the freshly-applied border segment is temporarily released during the border-hanging operation.

Yet another object of the invention is to provide a border retainer characterized by a retainer body having multiple wall insertion spikes for removably securing the retainer body to a wall and a retainer flange provided on the retainer body for engaging the free extending end portion of a decorative wall border segment after the border segment is applied to the wall, in order to prevent the border segment from inadvertently curling up and detaching from the wall as the border segment is temporarily released before the border application paste dries.

A still further object of the invention is to provide a border retainer characterized by a retainer body having multiple wall insertion spikes for removably securing the retainer body to a wall and at least one retainer clip provided on the retainer body for engaging the free end portion of a decorative wall border segment after the border segment is applied to a wall, to prevent the border segment from inadvertently curling up and detaching from the wall as the border segment is temporarily released before the border application paste dries.

Yet another object of the invention is to provide a border retainer characterized by a retainer body having an attachment panel; multiple wall insertion spikes removably or fixedly mounted on the attachment panel for insertion in a wall and removably attaching the retainer body to the wall; a bottom panel extending in substantially perpendicular relationship from the attachment panel; a retainer flange extending from the bottom panel or a retainer clip or clips provided on the retainer body for temporarily receiving and retaining the free end portion of a decorative wall border segment after application of the border segment to the wall; and a handle fitted on the attachment panel.

A still further object of the invention is to provide a border retainer characterized by a retainer body having an attachment panel; multiple wall insertion spikes removably or fixedly mounted on the attachment panel for insertion in a wall and removably attaching the retainer body to the wall; a curved retainer flange extending from the attachment panel for temporarily receiving and retaining the free end portion of a decorative wall border segment after the border segment is applied to the wall; and a handle fitted on the attachment panel.

SUMMARY OF THE INVENTION

These and other objects of the invention are provided in a border retainer for retaining a free end portion of a decorative wall border segment after the border segment is applied to a wall and before the border application paste dries, to prevent the applied border segment from inadvertently curling up and detaching from the wall typically while a ladder, equipment or furniture is repositioned preparatory to pasting an overlapping border segment on the wall. In a preferred embodiment, the border retainer is characterized by a retainer body having an attachment panel typically fitted with a handle, a bottom panel extending from the attachment panel and a curved retainer flange extending from the bottom panel. A pair of wall insertion spikes extends from fixed or removable attachment to a common surface of the attachment panel for insertion in the wall and removably attaching the retainer body to the wall with the retainer flange disposed in spaced-apart relationship to the wall. When it becomes necessary for the person hanging the border to release the border segment and descend a ladder to facilitate repositioning the ladder or other equipment or furniture, for example, the extending free end portion of the border segment, unpasted to the wall, is rested on the bottom panel and retained by the retainer flange, which prevents the border segment from curling up and detaching from the wall. After the border retainer is removed from the wall, the extending end portion of the border segment is pasted to the wall and a second border segment is typically pasted to the wall in overlapping relationship to the extending end portion of the first border segment. The overlapping border segment covers the small openings the wall caused by the wall insertion spikes of the border retainer. In another embodiment of the invention, at least one retainer clip is provided on the retainer body instead of or in addition to the retainer flange for holding the free extending end portion of the border segment. In still another embodiment, the retainer flange is semicircular and extends directly from the attachment panel.

BRIEF DESCRIPTION OF THE DRAWINGS

The invention will be better understood by reference to the accompanying drawings, wherein.

DESCRIPTION OF THE PREFERRED EMBODIMENTS

Figure 4:
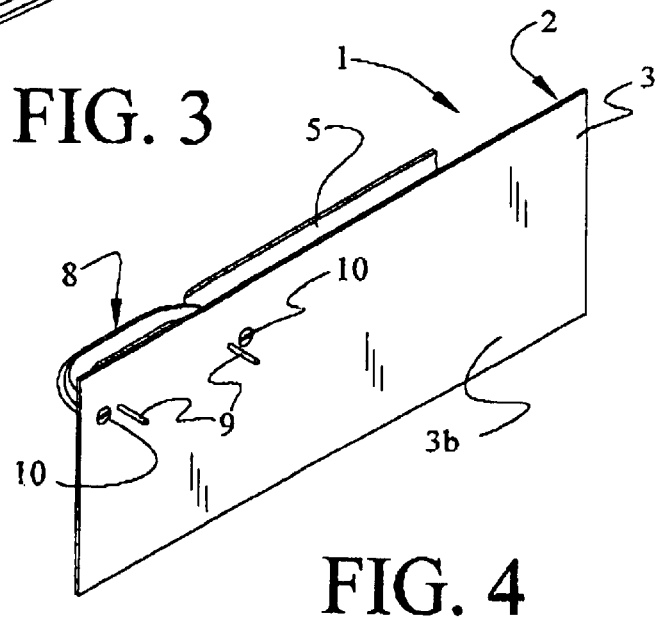
FIG. 4 is a rear perspective view of the border retainer, illustrating a pair of parallel, adjacent wall insertion spikes extending from the retainer body.
Figure 5:
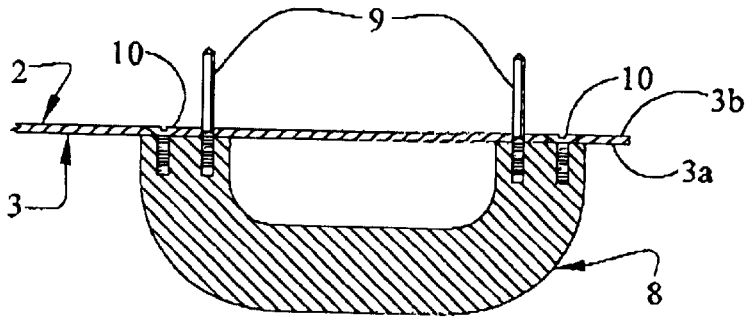
FIG. 5 is a sectional view, taken along section lines 5—5 in FIG. 3, of the handle component of the border retainer.
Figure 6:
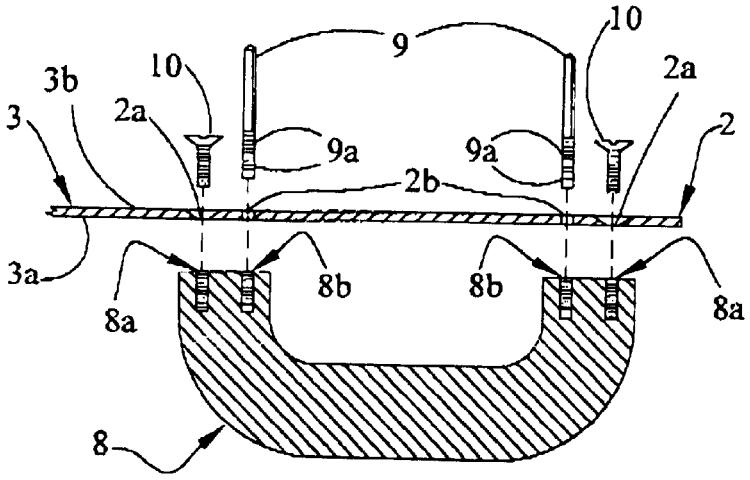
FIG. 6 is an exploded, sectional view, also taken along section lines 5—5 in FIG. 3, of the border retainer, with the wall insertion spikes and handle components of the border retainer shown detached from the retainer body and more particularly illustrating a screw technique for mounting the handle on the retainer body.
Figure 7:
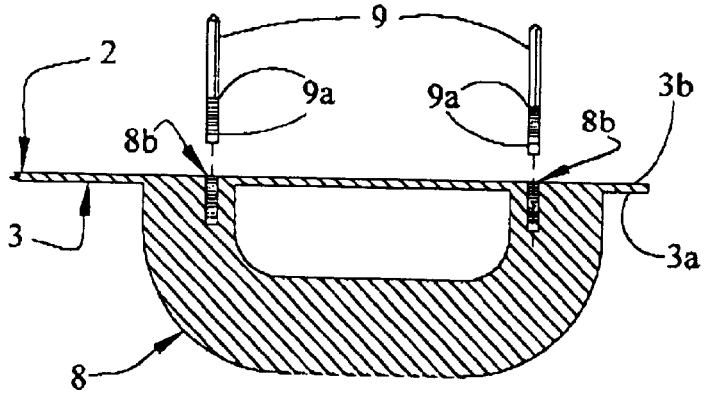
FIG. 7 is an exploded, sectional view, taken along section lines 5—5 in FIG. 3, of another embodiment of the border retainer, with the handle component fixedly mounted on the retainer body of the border retainer.

Referring initially to FIGS. 1–7 of the drawings, in a preferred embodiment the border retainer of this invention is generally illustrated by reference numeral 1. The border retainer 1 is characterized by a retainer body 2, typically constructed of lightweight plastic or fiberglass or a lightweight metal such as aluminum and including a rectangular attachment panel 3 having a retainer surface 3*a* and an opposite, attachment surface 3*b*. As particularly iillustrated in FIG. 3, a bottom panel 4 extends in substantially perpendicular relationship from the bottom edge of the attachment panel 3, adjacent to the retainer surface 3*a* thereof. A retainer flange 5 curves upwardly from the extending long edge of the retainer flange 4. As illustrated in FIGS. 5 and 6, a handle 8, which may be C-shaped as illustrated but may have any desired alternative configuration, is typically mounted on the retainer face 3*a* of the attachment panel 3 of the retainer body 2, typically by means of handle mount screws 10 extended through respective screw openings 2*a* provided in the attachment panel 3, and threaded in registering screw seats 8*a* provided in the handle 8, as illustrated in FIG. 6. Alternatively, as illustrated in FIG. 7 the handle 8 can be molded in one piece with the attachment panel 3 or otherwise fixedly or removably attached to the attachment panel 3 according to the knowledge of those skilled in the art. As illustrated in FIG. 4, a pair of parallel, adjacent wall insertion spikes 9, the purpose of which will be hereinafter described, extends from the attachment surface 3*b* of the attachment panel 3 of the retainer body 2. In a preferred embodiment of the invention, the wall insertion spikes 9 are removably threaded or otherwise secured in the retainer body 2, typically as illustrated in FIG. 6, by extending each wall insertion spike 9 through a corresponding spike opening 2*b* provided in the attachment panel 3 and engaging spike threads 9*a* on the wall insertion spike 9 with companion seat threads (not illustrated), provided in a corresponding spike seat 8*b* in the handle 8. In the embodiment illustrated in FIG. 7, the wall insertion spikes 9 are in like manner threaded in the spike seats 8*b* provided in the handle 8. It is understood that while the wall insertion spikes 9 can be fixedly mounted in the retainer body 2 according to the knowledge of those skilled in the art, the removable wall insertion spikes 9 are preferred since they facilitate replacement of bent, distorted or broken wall insertion spikes 9 which may result from repeated use of the border retainer 1 as hereinafter described.

Figure 1:
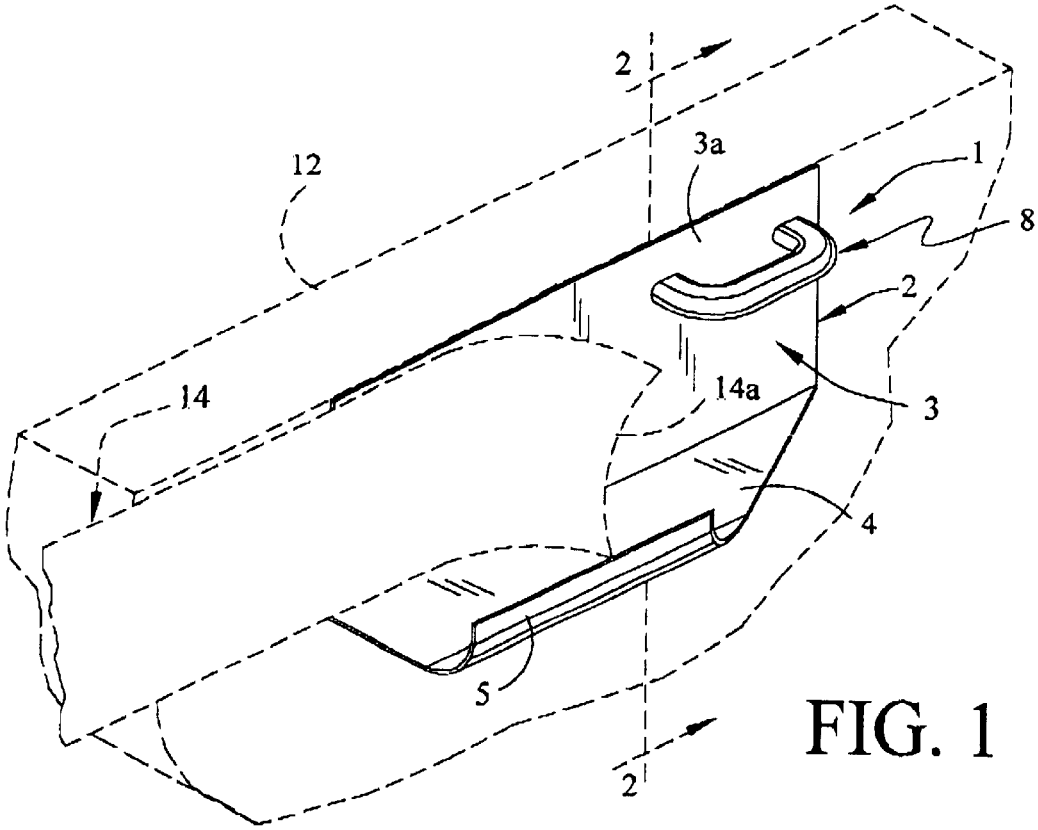
FIG. 1 is a perspective view of a preferred embodiment of the border retainer of this invention, illustrated in solid lines, with the border retainer shown removably attached to a wall (illustrated in phantom) and retaining the free extending end portion of a decorative wall border segment (also in phantom) in typical application of the border retainer.
Figure 2:
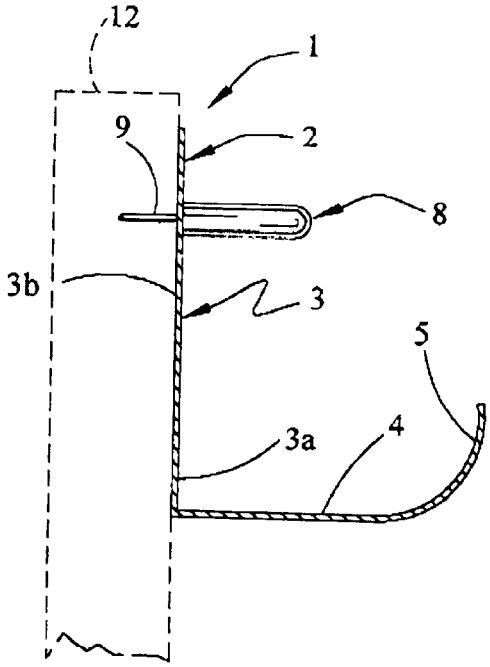
FIG. 2 is a sectional view, taken along section line 2—2 in FIG. 1, of the border retainer.
Figure 3:
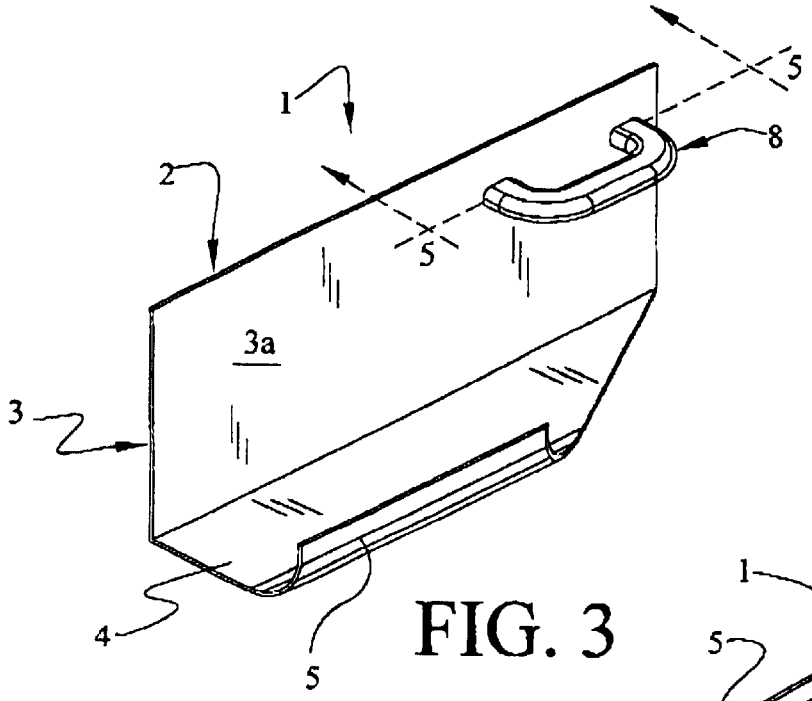
FIG. 3 is a front perspective view of the border retainer.

Referring again to FIGS. 1 and 2 of the drawings, in typical application the border retainer 1 is used to retain the free extending end portion 14*a* of a border segment 14 of a decorative wall border after the border segment 14 is applied to the interior surface of a wall 12, under circumstances in which it is necessary to temporarily release the border segment 14 before the application paste of the border segment 14 dries. Accordingly, the border segment 14 is initially prepared for application to the wall 12 by wetting the paste surface (not illustrated) of the border segment 14 to activate the paste on the border segment 14, or by applying a paste to the border. The wetted or pasted paste surface of the border segment 14 is then progressively pressed against the wall 12 along the length of the border segment 14, from one end (not illustrated) toward the extending end portion 14*a* of the border segment 14. As the person hanging the border segment 14 completes application of the border segment 14 to the wall 12, he or she initially leaves the extending end portion 14*a* of the border segment 14 unattached to the wall 12, as illustrated in FIG. 1. The retainer body 2 of the border retainer 1 is then removably attached to the wall 12 by grasping the handle 8 and pushing the parallel wall insertion spikes 9 into the wall 12 until the attachment surface 3*b* of the attachment panel 3 contacts the interior surface of the wall 12, as illustrated in FIG. 2. The free extending end portion 14*a* of the border segment 14 is next rested on the bottom panel 4 of the retainer body 2, as further illustrated in FIG. 1. The border segment 14, dispensed from a packaging roll or spool (not illustrated), typically has a tendency to curl up and detach from the wall 12 before the border application paste dries, beginning at the extending end 14*a* and progressing toward the first-applied opposite end (not illustrated) of the border segment 14 since the border application paste toward the first-applied end of the border segment 14 has partially dried by the time the border hanger reaches the extending end 14*a*. Accordingly, the unpasted free extending end portion 14*a* of the border segment 14 curls and engages the retainer flange 5, which prevents continued curling of the border segment 14 and detachment of the border segment 14 from the wall 12 as the border application paste continues to dry. Accordingly, the border hanger can release the border segment 14 as he or she descends a ladder (not illustrated), for example, to relocate the ladder or other equipment or furniture. After the ladder, furniture or equipment has been relocated, the border hanger removes the retainer body 2 from the wall 12 by removing the wall insertion spikes 9 from the wall 12, and pastes the remaining free extending end portion 14*a* of the border segment 14 to the wall 12. A second border segment 14 is then typically applied to the wall 12 in overlapping relationship to the first border segment 14, and the procedure is repeated until a continuous decorative wall border is applied to the wall 12. It will be appreciated by those skilled in the art that the spike openings (not illustrated) which remain in the wall 12 due to insertion of the wall insertion spices 9 therein are typically small and are confined to the application path of the overlapping second border segment 14. Accordingly, the spike openings are completely covered and hidden by the overlapping second border segment 14 and thus, are not visible after application of the decorative wall border.

Figure 8:
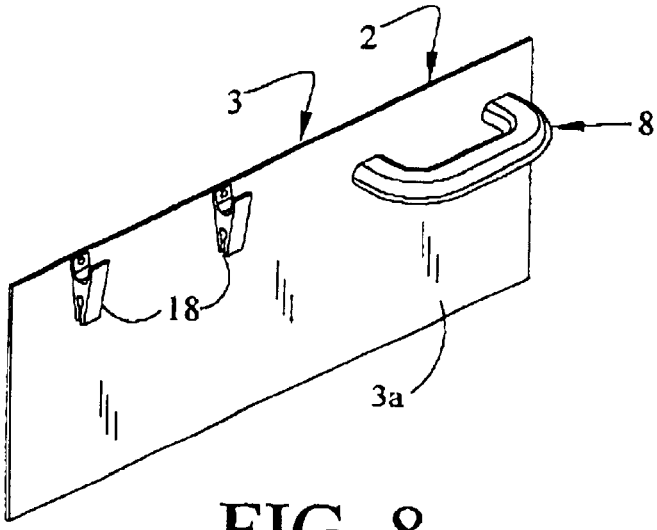
FIG. 8 is a front perspective view of the attachment panel component of still another embodiment of the border retainer, more particularly illustrating a pair of retainer clips provided on the attachment panel for retaining a border segment in application of the border retainer.

Referring next to FIG. 8 of the drawings, in another embodiment of the border retainer of this invention, one or more typically spring-operated retainer clips 18 of selected design is mounted typically on the retainer surface 3*a* of the attachment panel 3 of the retainer body 2, as illustrated, in addition to or instead of the retainer flange 5 described above with respect to the embodiment illustrated in FIGS. 1–7. The retainer clips 18 are operated to secure the free extending end portion 14*a* of the border segment 14 in the same manner and for the purpose described above with respect to the retainer flange 5.

Figure 9:
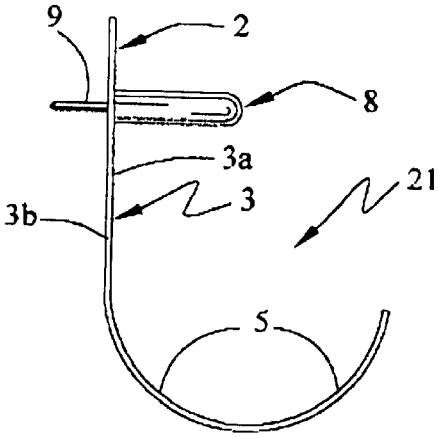
FIG. 9 is a side view of yet another embodiment of the border retainer of this invention.

Referring next to FIG. 9 of the drawings, in still another embodiment of the border retainer generally illustrated by reference numeral 21, the retainer flange 5 is semicircular and extends in a curved trajectory from the bottom edge of the attachment panel 3 of the retainer body 2, and replaces the planar bottom panel 4 heretofore described with respect to FIGS. 1–7. Accordingly, the retainer flange 5 is capable of both supporting and retaining the free extending end portion 14*a* (FIG. 1) of the border segment 14 as the border segment 14 is temporarily released after application to a wall 12, as heretofore described. It is understood that the border retainer 21 illustrated in FIG. 9 can be constructed without or with the retainer clips 18 described above with respect to FIG. 8, which retainer clips 18 in the latter case can be used instead of the curved retainer flange 5, as desired, to secure the extending end portion 14*a* of the border segment 14.

It will be appreciated by those skilled in the art that the border retainer of this invention provides an effective mechanism for temporarily retaining the free extending end portion of a border segment freshly-applied to a wall in order to prevent inadvertent detachment of the border segment from the wall under circumstances in which the border segment must be temporarily released before the border application paste dries during the border-hanging operation. Referring again to FIG. 4 of the drawings, it is understood that any number of wall insertion spikes 9 can be provided on the retainer body 2 in any desired pattern to facilitate securing the retainer body 2 to a wall although two of the wall insertion spikes 9, as illustrated, are usually sufficient due to the lightweight plastic, fiberglass or metal construction of the retainer body 2.

Referring again to FIGS. 6 and 7 of the drawings, it will be appreciated by those skilled in the art that in the event that the removable wall insertion spikes 9 become bent, damaged or distorted due to repeated use of the border retainers of this invention, the removable wall insertion spikes 9 can be replaced by straight wall insertion spikes, as deemed necessary. This is accomplished by unthreading the bent, damaged or distorted wall insertion spikes 9 from the respective spike seats 8*b* of the retainer body 2 and threading replacement wall insertion spikes 9 in the spike seats 8*b*.

While the preferred embodiments of the invention have been described above, it will be recognized and understood that various modifications can be made in the invention and the appended claims are intended to cover all such modifications which may fall within the spirit and scope of the invention.

Having described our invention with the particularity set forth above, we claim:

1. A method for retaining a free end portion of a border segment of a decorative wall border as the border is applied to a wall, said method comprising:

(a). providing a border retainer comprising a retainer body, a plurality of wall insertion spikes extending from said retainer body in substantially adjacent, parallel relationship with respect to each other for removable insertion in the wall and attaching said retainer body to the wall, and a retainer mechanism provided on said retainer body for engaging the free end portion of the border segment;

(b). applying the border segment to the wall, with the free end portion of the border segment initially unapplied to the wall and wherein the free end portion of the border segment remains disengaged from said retainer mechanism as the border segment is applied to the wall;

(c). inserting said plurality of wall insertion spikes in the wall adjacent to the free end portion of the border segment to attach said border retainer to the wall; and (d). causing engagement of said retainer mechanism of said border retainer with the free end portion of the border segment.

2. The border retainer of claim 1 wherein said retainer mechanism comprises a retainer flange.

3. The border retainer of claim 1 wherein said plurality of wall insertion spikes comprises a pair of wall insertion spikes.

4. The border retainer of clam 3 wherein said retainer mechanism comprises a retainer flange.

5. The border retainer of claim 1 wherein said retainer mechanism comprises at least one retainer clip.

6. The border retainer of claim 5 wherein said plurality of wall insertion spikes comprises a pair of wall insertion spikes.

7. The border retainer of claim 1 wherein each of said plurality of wall insertion spikes is removably attached to said retainer body.

8. The border retainer of claim 7 wherein said retainer mechanism comprises a retainer flange.

9. The border retainer of claim 7 wherein said plurality of wall insertion spikes comprises a pair of wall insertion spikes.

10. The border retainer of claim 9 wherein said retainer mechanism comprises a retainer flange.

11. The border retainer of claim 7 wherein said retainer mechanism comprises at least one retainer clip.

12. The border retainer of claim 11 wherein said plurality of wall insertion spikes comprises a pair of wall insertion spikes.

13. A border retainer for retaining a free end portion of a decorative wall border as the border is applied to a wall, said border retainer comprising:

(a). a retainer body comprising an attachment panel;

(b). a retainer flange carried by said attachment panel of said retainer body, said retainer flange adapted for engaging the free end portion of the decorative wall border in stationary relationship; and (c). a plurality of wall insertion spikes extending from said retainer body in substantially adjacent, parallel relationship with respect to each other for removable insertion in the wall and attaching said retainer body to the wall.

14. The border retainer of claim 13 wherein said plurality of wall insertion spikes comprises a pair of wall insertion spikes.

15. The border retainer of claim 13 wherein each of said plurality of wall insertion spikes is removably attached to said retainer body.

16. The border retainer of claim 15 wherein said plurality of wall insertion spikes comprises a pair of wall insertion spikes.

17. A border retainer for retaining the free end portion of a decorative wall border as the border is applied to a wall, said border retainer comprising:

(a) a retainer body;

(b) a handle provided on said retainer body;

(c) a plurality of wall insertion spikes extending from said retainer body in substantially adjacent, parallel relationship with respect to each other for removable insertion in the wall and attaching said retainer body to the wall; and (d) at least one retainer clip provided on said retainer body for engaging the free end portion of the border segment.

18. The border retainer of claim 17 wherein said plurality of wall insertion spikes comprises a pair of wall insertion spikes.

19. The border retainer of claim 17 wherein each of said plurality of wall insertion spikes is removably attached to said retainer body.

20. The border retainer of claim 19 wherein said plurality of wall insertion spikes comprises a pair of wall insertion spikes.

* * * * *